United States Patent [19]

Olson

[11] 4,085,655

[45] Apr. 25, 1978

[54] CONTROL FOR RECIPROCATING PUMPS OR THE LIKE

[76] Inventor: Lawrence P. Olson, 18006 Pine Ave., Fontana, Calif. 92335

[21] Appl. No.: 671,121

[22] Filed: Mar. 29, 1976

[51] Int. Cl.[2] ..... F01L 25/06

[52] U.S. Cl. ..... 91/307; 91/320; 251/172

[58] Field of Search ..... 91/319, 300, 309, 306, 91/307, 320; 251/172

[56] References Cited

U.S. PATENT DOCUMENTS

| | | | |
|---|---|---|---|
| 50,218 | 10/1865 | Cameron | 91/306 |
| 330,068 | 11/1885 | Sergeant | 91/320 |
| 508,430 | 11/1893 | Leyner | 91/320 |
| 544,476 | 8/1895 | Burnham | 91/306 |
| 567,682 | 9/1896 | Leyner | 91/320 |
| 3,166,993 | 1/1965 | Blenkle | 92/249 |
| 3,472,484 | 10/1969 | Parker | 251/172 |
| 3,540,349 | 11/1970 | Pennther | 91/306 |
| 3,556,151 | 1/1971 | Masuda | 251/172 |

*Primary Examiner*—Paul E. Maslousky
*Attorney, Agent, or Firm*—John H. Crowe

[57] ABSTRACT

A control valve for alternately applying fluid pressure to two drive members of a reciprocating work device such as a pump. A valve piston is slideable in a closed cylinder to which pressurized fluid is transmitted. The valve piston, controls the fluid depending on the position of the piston in its cylinder, to pressurize one chamber and vent the other so as to move the work device in one direction or the other. In turn, the work device controls the fluid to position the valve piston.

1 Claim, 7 Drawing Figures

FIG. 1.
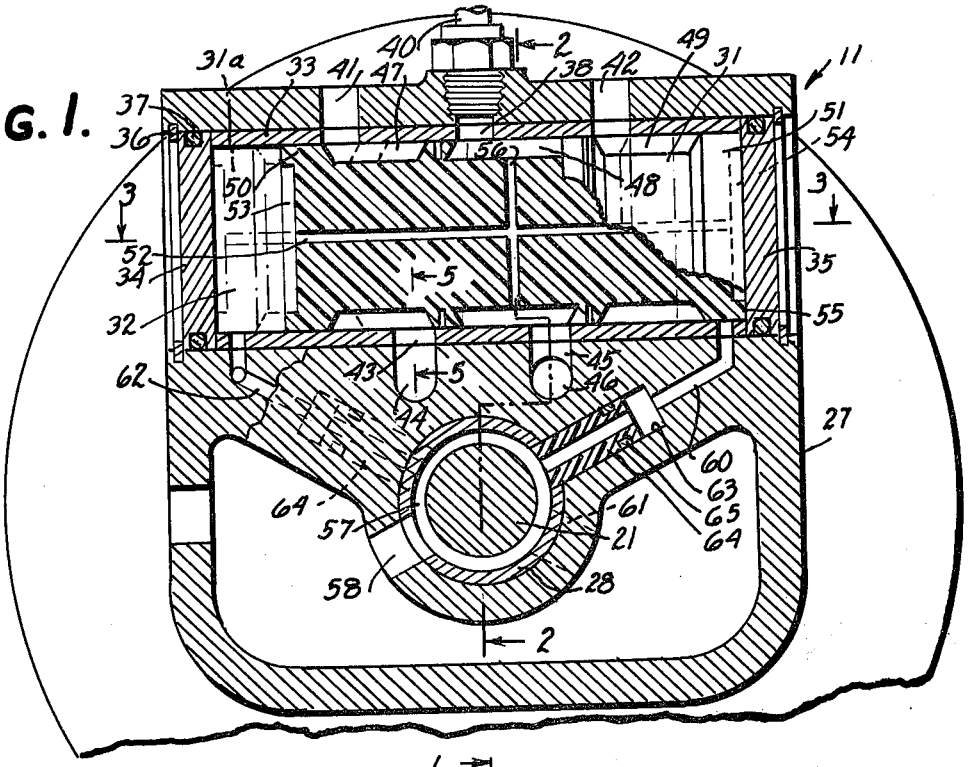
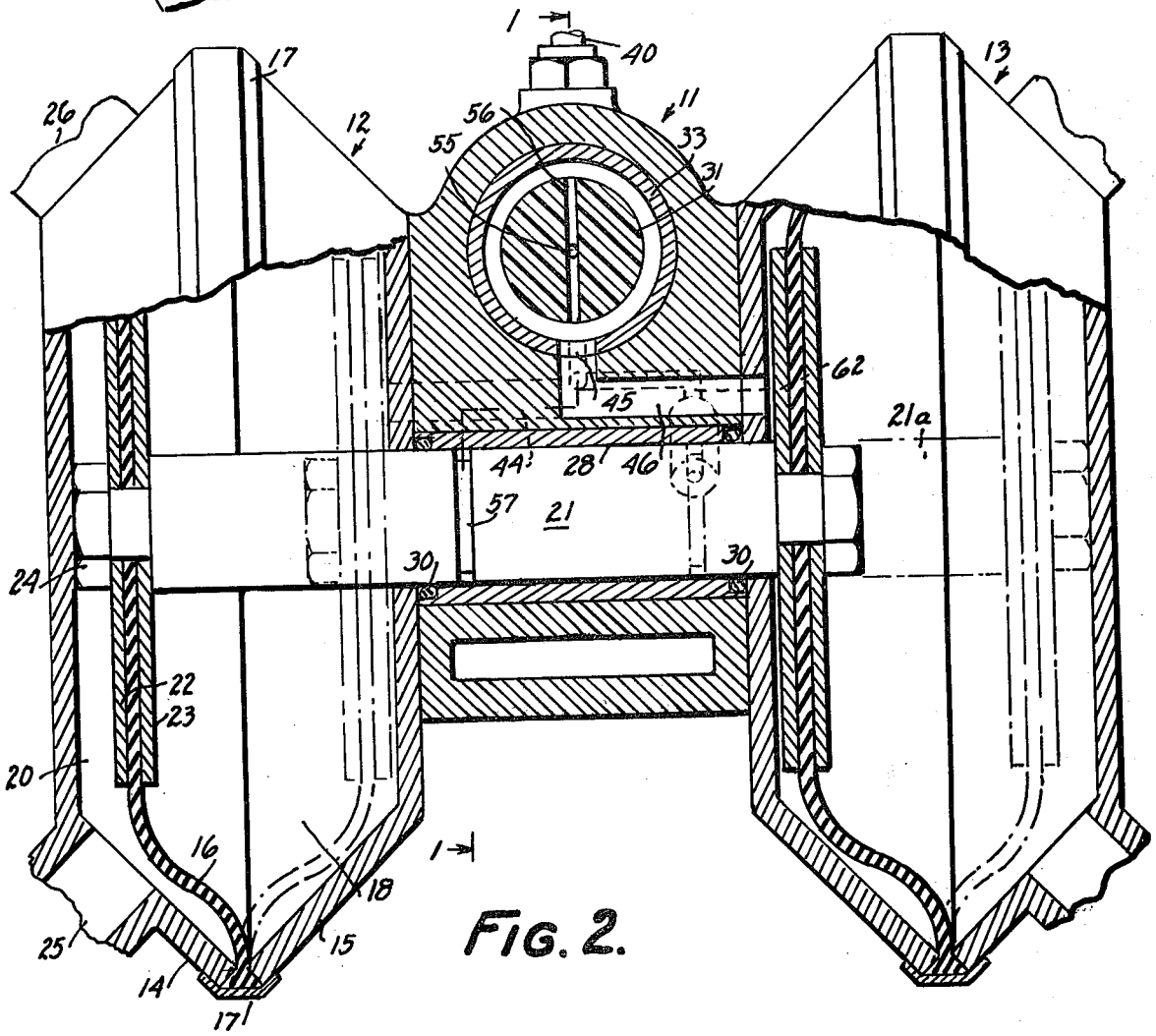
FIG. 2.

CONTROL FOR RECIPROCATING PUMPS OR THE LIKE

BACKGROUND OF THE INVENTION

1. Field of the Invention

This invention relates to control valves for controlling the operation of fluid operated reciprocal pumps or the like work devices.

2. Description of the Prior Art

Fluid operated diaphragm or piston pumps have been employed heretofore in which two diaphragm or piston chambers are provided which are alternately pressurized to reciprocate a work device to perform such work as pumping a liquid. Such pumps generally employ a valve including a sliding valve member which is shifted from one position to another when the work device reaches one end of its stroke to vent a pressurized chamber and to apply pressure to the other chamber. This action is reversed when the work device reaches the opposite end of its stroke.

Although such prior control valves are generally satisfactory, they have certain drawbacks. For example, the valve disclosed in the U.S. Pat. to J. K. Wilden, No. 3,071,118, issued on Jan. 1, 1963, employs such a shiftable valve member. In this case, pressurized air is admitted into the valve cylinder to shift the valve member to cover and uncover certain ports and also to press the valve member laterally so as to effectively seal the covered ports. Where relatively high air pressure is employed a considerable side thrust is applied to the valve member, tending to cause abnormal wear. Also, due to the high friction forces developed between the valve member and the cylinder wall, the valve member tends to stick during movement between its two controlling positions. Further, certain valves of this type must be properly oriented with the valve member movable in a vertical direction so that when pressurized air is removed, the valve member will return by gravity to one of its alternate positions in preparation for subsequent operation. A further defect of certain valves of the above type is that the sliding valve member may strike limit stops at the opposite ends of its stroke with abnormal force, thereby creating considerable noise and ultimately damaging the valve member.

SUMMARY OF THE INVENTION

A principal object of the present invention is to increase the reliability of a control valve of the above type.

Another object is to reduce wear of a control valve of the above type.

Another object is to reduce the operating force necessary to operate a control valve of the above type.

Another object is to provide a control valve of the above type capable of operating effectively under a wide range of operating pressures.

Another object is to provide a simple and inexpensive control valve having a minimum number of parts.

A further object is to provide an improved sliding seal for a control valve or the like.

BRIEF DESCRIPTION OF THE DRAWINGS

The manner in which the above and other objects of the invention are accomplished will be readily understood on reference to the following specification when read in conjunction with the accompanying drawings, wherein:

FIG. 1 is a sectional view through a reciprocating pump actuator and a control valve therefor embodying a preferred form of the present invention.

FIG. 2 is a transverse sectional view taken substantially along the line 2—2 of FIG. 1.

DESCRIPTION OF THE PREFERRED EMBODIMENT

Figure 3:
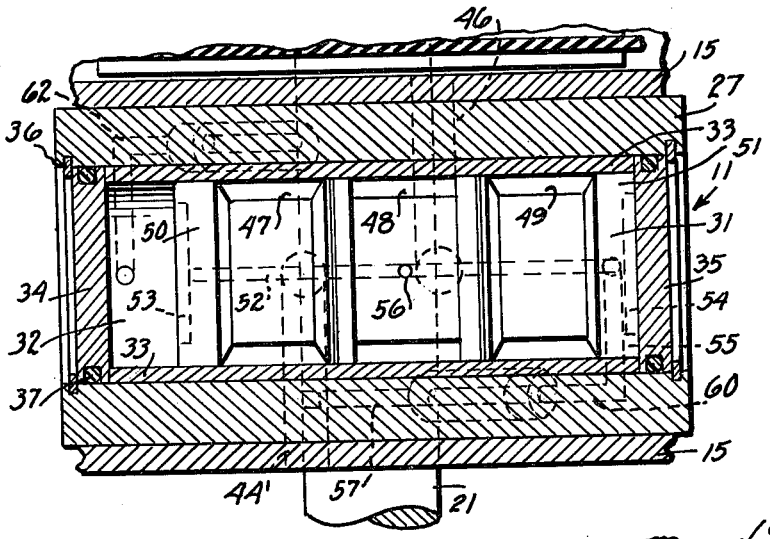
FIG. 3 is a sectional plan view taken along the line 3—3 of FIG. 1.

Referring to FIGS. 1 to 5 in particular, a control valve generally indicated at 11 is shown in operative relation to a work device in the form of a diaphragm type pump, including a pair of spaced diaphragm chambers 12 and 13. Each chamber is formed of two dished chamber members 14 and 15 clamped to the periphery of a flexible diaphragm 16 by a clamp ring 17. Thus, each diaphragm separates its respective chamber into an inner air receiving chamber 18 and an outer liquid pumping chamber 20.

The diaphragms 16 are mounted on the opposite ends of a pump shaft 21 and for this purpose, each diaphragm is clamped between two stiffener disks 22 and 23 by a nut 24 threaded on a reduced respective end of the shaft. Reciprocation of the pump shaft 21 in the manner to be described displaces the diaphragms in unison to apply a pumping action to liquid admitted into the outer chambers i.e. 20, through opening 25 or 26. Diaphragm pumps of this basic type are well known in the art, as disclosed, for example, in the U.S. Pat. to L. H. Browne, No. 2,625,886, issued on Jan. 20, 1953.

The chamber members 15 are suitably secured to the opposite sides of a valve housing 27 and shaft 21 is slideably mounted in a bearing sleeve 28 fitted within a bore in the housing. O-ring seals 30 are provided at opposite ends of sleeve 28 to seal against shaft 21.

A valve piston 31, preferably formed of tetrafluoroethylene plastic (Teflon) is slideably mounted in a cylinder 32 formed by a bearing sleeve 33 mounted in a bore formed in housing 27. The sleeve 33 is retained in place by end caps 34 and 35 which in turn, are retained by snap rings 36. O-rings 37 are mounted in grooves in the end caps to hermetically seal the ends of the cylinder 32.

An inlet port 38 is formed in the housing 27 and sleeve 33 to communicate the cylinder 32 with a supply line 40 for a source of pressurized air. Vent or outlet ports 41 and 42 are formed in the housing 27 and sleeve 33 on opposite sides of the port 38. A discharge port 43 opens into the cylinder 32 intermediate the inlet port 38 and vent port 41 and communicates with the inside diaphragm compartment 18 of diaphragm chamber 12 through a passage 44. Similarly, a second delivery port 45 opens into the cylinder 32 intermediate the inlet port 38 and vent port 42 and communicates with the inside compartment of diaphragm chamber 13 through a passage 46.

The piston 31 is formed with three annular recesses 47, 48 and 49 leaving skirts 50 and 51 at opposite ends which slideably engage the cylinder 32. When the piston 31 is in its right hand, full line position of FIGS. 1 and 3, the recess 48 communicates the inlet 38 with the delivery port 45 and thus with the inner compartment of diaphragm chamber 13. Also, recess 47 communicates vent port 41 with delivery port 43 and therefore with the inner compartment of diaphragm chamber 12. Thus, piston 31 enables the chamber 13 to be pressurized and the chamber 12 to be vented, causing the diaphragms 16 and shaft 21 to be moved to the right, permitting intake of liquid to the diaphragm chamber 12 and expelling of liquid from chamber 13.

When the piston 31 is moved to its left hand position as indicated by dotted lines 31*a*, FIG. 1, recess 48 communicates the inlet port 38 with discharge port 43 to pressurize chamber 12 and recess 49 communicates vent port 42 with discharge port 45 to vent chamber 13, thereby expelling liquid from chamber 12 and causing an intake of liquid into chamber 13.

A relatively small axially extending passage 52 is formed in the piston 31 and opens into shallow cavities 53 and 54 at opposite ends of the piston. Such cavities leave annular sealing lips 55 at the ends of the piston which are effective to seal against the associated end caps 34 and 35. The passage 52 intersects a cross passage 56 extending transversely through the piston 31. Thus, passage 52 and the opposite ends of the piston 31 are always subjected to the pressurized air admitted into the cylinder 32.

Valve means are provided under control of the pump shaft 21 to vent one or the other end of the cylinder 32, depending upon the position of the pump shaft at opposite ends of its stroke to enable the pressurized air to shift the piston into such vented end of the cylinder. For this purpose, a circumferential groove 57 is formed in shaft 21. When the shaft is in its extreme left hand position, as shon in FIG. 2, the groove 57 is aligned with both a vent passage 58, FIG. 1, and a passage 60 opening into the cylinder 32 a short distance from the end cap 35 (see also FIG. 3). When the piston 31 is in its right hand position of FIG. 1, the skirt 51 overlies the opening of passage 60 and thus seals off such passage.

When the shaft 21 is moved to the extreme right hand end of its stroke as indicated by the dot-dash lines 21*a* of FIG. 2, the groove 57 becomes aligned with a second vent passage 61 and aligned passage 62 opening into the left hand end of the cylinder 31 a short distance from the end cap 34. When the piston 31 is in its left hand position, the skirt 50 thereof overlies the passage 62 and thus seals off the same.

In order to form an effective sliding seal against the shaft 21, each of the passages 60 and 62 is formed with a counterbore 63 to slideably receive a hollow piston 64, preferably of Teflon. An O-ring 65 is mounted in a groove formed in the piston 64 to form a sliding seal between the piston and the counterbore 63. When the passage, i.e. 60, is pressurized, such pressure will yieldably force the piston 64 downwardly to slideably seal the same against the shaft 21. Any wear on the lower end of the piston 64 will have no effect on its sealing ability since it will merely move downwardly until proper sealing is effected.

It will be noted that each of the passages 60 and 62 has a relatively greater cross sectional area than the cross sectional area of the passage 52. Thus the passage 52 restricts flow of air therethrough to a greater extent than do the passages 60 and 62. This enables air compressed within piston cavity 54 to expand to drive the piston 31 toward the vented end of the cylinder 32.

Figure 4:
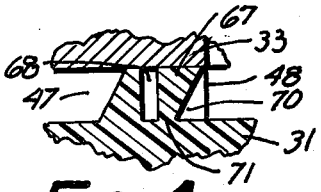
FIG. 4 is a fragmentary enlarged sectional view illustrating the sliding seal construction of the valve piston.

According to one aspect of the invention, the plastic piston 31 is formed with integral sliding seals, FIG. 4, intermediate the recesses 47, 48 and 49. Each said seal comprises a ring section 67 having an inverted triangular cross section. This section is formed by undercutting the land or large diameter part of the piston at an angle as seen at 70 and forming a narrow annular groove 68 having a root diameter substantially equal to the root diameter of the recess 48. Groove 68 extends adjacent the undercut portion 70 to permit a slight axial flexing of the ring 67 about its root section 71. Thus, as pressure increases in the recess, i.e. 48, the ring section 67 tends to swing about its root section 71 and thus expand radially to form a greater sealing engagement with the cylinder 32.

Figure 5:
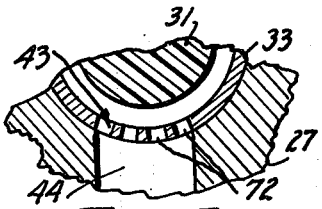
FIG. 5 is a fragmentary transverse sectional view through one of the valve ports and is taken along the line 5—5 of FIG. 1.

As seen in FIG. 5, the portion of each of the ports, i.e. 43, formed in sleeve 33 is divided into a series of small spaced openings 72 to permit one of the sealing rings, i.e. 67, of piston 31 to pass thereover without catching the edges of the same. The size of each port, i.e. 43, may thus be varied as desired by omitting one or more of such smaller openings 72.

Figure 6:
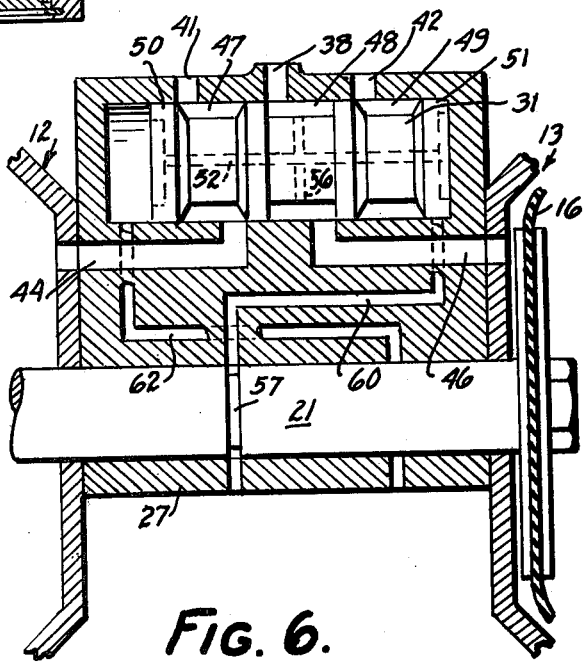
FIG. 6 is a schematic sectional view illustrating the operation of the control valve and pump.

In order to more clearly understand the operation of the control valve and pump actuator, reference is had to the schematic view of FIG. 6. Assuming the elements are in their position shown in FIG. 6 and that pressurized air is admitted into the inlet 38, the air will be applied through recess 48 in piston 31, through discharge passage 46 and into the diaphragm chamber 13 to move the pump shaft 21 to the right. Pressurized air will also be applied through passage 52 in piston 31 to both ends thereof. However, at this moment, vent passage 62 will be closed since groove 57 is aligned with the vent passage 60 and vent passage 60 is closed by the skirt 51 of piston 31. Therefore, shaft 21 is moved to the right and piston 31 remains in its right hand position. As groove 57 moves into alignment with vent passage 62 it relieves the air pressure at the left hand end of piston 31, permitting the pressurized air at the right hand end of the piston to impel the latter leftward toward its left hand position. Shortly before reaching such position, the skirt 50 covers the openings of passage 62 so that a remaining cushion of air is trapped between the piston and the left hand end of the cylinder to gradually retard the piston to reduce impact and consequent noise and damage thereto. As the piston 31 moves into its left hand position pressurized air will be transmitted through annular recess 48 of the piston and passage 44 to move the diaphragm 16 in chamber 12 and shaft 21 to the left while air in the chamber 13 will be vented through passage 46, recess 49 and vent passage 42.

Such sequence of operations will be continually repeated as long as the pressurized air is applied to the inlet 38.

In the event the pump unit is submerged in the liquid it is to pump, the vent ports 41 and 42 may be connected with check valves, not shown, to prevent entrance of the liquid into the valve or such vent ports may be connected with suitable pipes, not shown, to the atmosphere at points above the surface of the liquid.

DESCRIPTION OF ALTERNATIVE EMBODIMENT

Figure 7:
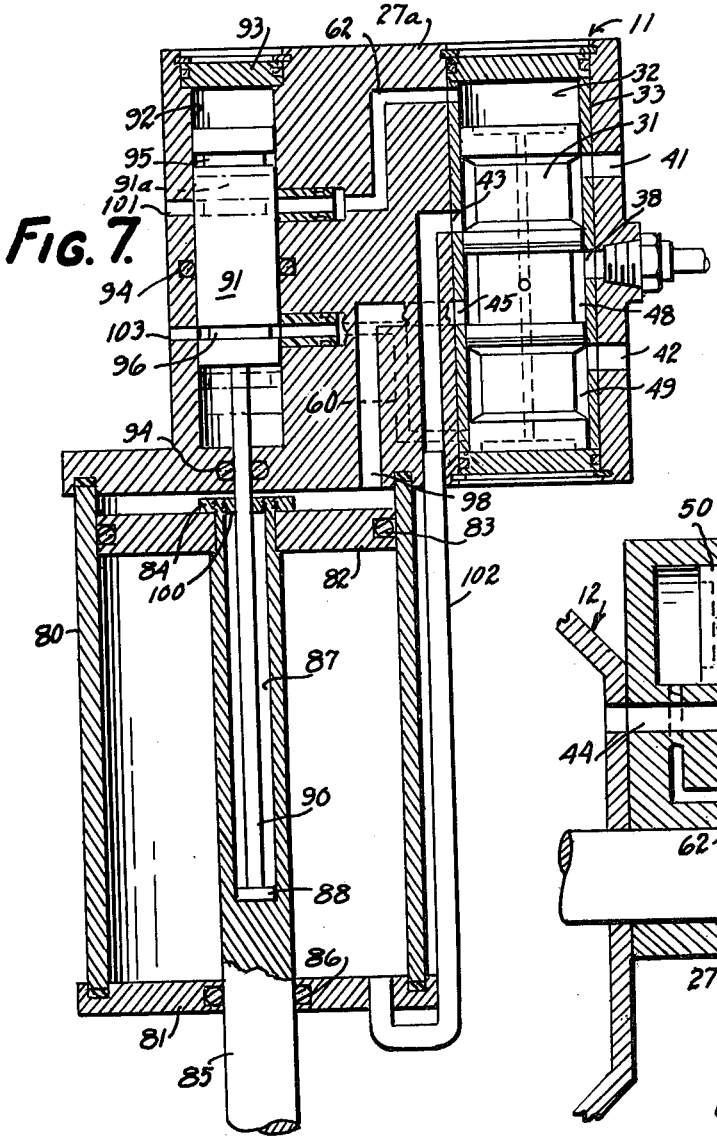
FIG. 7 is a sectional view of a modified form of pump actuator illustrating the control valve of the present invention and means for controlling the valve.

FIG. 7 illustrates an alternative embodiment of the invention as applied to a reciprocating piston pump or like work device. Here, the control valve 11 is similar to that shown in FIGS. 1 to 6 and the parts thereof will be identified by similar reference numerals.

The valve housing 27*a* is modified to receive and seal one end of a cylinder 80, the other end of which is sealed by an end cap 81 suitably secured thereto. A piston 82 is slideably mounted in the cylinder and is provided with an O-ring 83 mounted in a groove thereof to form a slideable seal, thus dividing the cylinder into an upper chamber and a lower chamber. Piston 82 is secured by a threaded nut 84 to the upper end of a pump shaft 85, the latter extending through an opening in the end cap 81 and slideably sealed therein by an O-ring 86 mounted in a groove in the end cap.

The upper end of the shaft 85 has an axially extending opening 87 therein to slideably receive the head 88 of a rod 90 which is attached to a valve member 91 slideable endwise in a bore 92 formed in the housing 27*a*. The bore is closed at its upper end by an end cap 93 and at its lower end by the lower wall of the housing, an O-ring 94 being provided to slideably seal the bore against leakage of pressurized air along the rod 90. A second O-ring 94 is provided in a groove surrounding the bore 92 to form a sliding seal for the valve member 91 and also to yieldably retain the same in different adjusted positions along the bore.

Valve member 91 has two spaced circumferential grooves 95 and 96 formed therein.

Assuming the parts to be in their positions illustrated in FIG. 7, pressurized air admitted through the inlet 38 will pass through annular recess 48 in the piston 31, through discharge port 45, and a passage 98 into the upper chamber of the cylinder 80 to drive the piston 82 and pump rod 85 downwardly. As the piston 82 reaches the lower end of its stroke, a hollow nut 100 threaded in the upper end of the opening 87 of the pump rod 85 will engage the head 88 of rod 90 to lower the valve member 91 into its dotted line position 91*a*, aligning the upper groove 95 thereof with the passage 62 and with a vent port 101. Accordingly, the upper end of the valve cylinder 32 will be vented, permitting pressurized air at the lower end of the piston 31 to raise the piston into its upper controlling position wherein its recess 48 will transmit pressurized air from inlet 38 through discharge port 43 and coextensive air line 102 to the lower end of cylinder 80 whereby to drive the piston 82 and pump rod 85 upwardly. Concurrently, the upper compartment of the cylinder 80 will be vented through passage 98, recess 49 and vent port 42.

As the piston 82 approaches the upper end of its stroke, the rod 85 will pick up the rod 90, returning the valve member 91 to its illustrated upper position wherein the groove 96 will be aligned with the vent passage 60 and a vent port 103. Thus, the lower end of the valve cylinder 32 will be vented, permitting pressurized air to drive the piston 31 downwardly into its illustrated position to cause a recurrence of the aforementioned cycle of operations.

It will be obvious to those skilled in the art that many variations may be made in the exact construction shown without departing from the spirit and scope of this invention.

I claim:

1. A control valve for alternately applying fluid pressure to a first and second work chamber to cause a reciprocating stroke of a work device, comprising:

a valve housing having a cylinder therein closed at opposite ends, an inlet in said housing for admitting pressurized fluid into said cylinder, means forming a first delivery passage communicating said cylinder with said first chamber, means forming a second delivery passage communicating said cylinder with said second chamber, means forming first and second outlet passage in said housing and opening into said cylinder, a piston slidable in said cylinder between first and second positions, said piston having annular recesses therein effective when said piston is in said first position to communicate said inlet with said first delivery passage and to communicate the second outlet passage with said second delivery passage, said recesses being effective when said piston is in said second position to communicate said inlet with said second delivery passage and to communicate the first outlet passage with said first delivery passage, an additional passage extending through said piston between opposite ends thereof, said piston having cavities at said opposite ends and said additional passage opening into said cavities, means for admitting pressurized fluid into said additional passage, first vent means controlled by said work device when at one end of said stroke to vent one end of said cylinder whereby to enable pressurized fluid at the opposite end of said cylinder to move said piston to said one end of said cylinder, and second vent means controlled by said work device when at the opposite end of said stroke to vent the opposite end of said cylinder whereby to enable pressurized fluid at said one end of said cylinder to move said piston to said opposite end of said cylinder, said piston having a large diameter portion intermediate certain of said recesses therein, which large diameter portion is in sliding engagement with said cylinder and is undercut toward the root of an adjacent one of said recesses, and said large diameter portion having a circumferential groove therein, the root of said groove extending adjacent the root of said undercut portion whereby to form a ring section having a flexible root section, said ring section flexing about said root section upon application of fluid pressure in said adjacent recess.

* * * * *